United States Patent [19]

Stimson

[11] 4,001,856

[45] Jan. 4, 1977

[54] PHOTOGRAPHIC PROCESSING APPARATUS

[76] Inventor: Paul B. Stimson, Neck Road R.F.D. No. 4, Old Lyme, Conn. 06371

[22] Filed: Apr. 4, 1975

[21] Appl. No.: 564,995

[52] U.S. Cl. ..... 354/331; 354/341

[51] Int. Cl.[2] ..... G03D 13/02

[58] Field of Search ..... 354/311, 312, 313, 316, 354/331, 340, 341, 343, 297, 333, 335, 336, 338; 134/64 P, 122 P

[56] References Cited

UNITED STATES PATENTS

| | | | |
|---|---|---|---|
| 1,395,160 | 10/1921 | Stockwell | 354/313 |
| 2,119,230 | 5/1938 | Hagen | 354/316 |
| 2,804,003 | 8/1957 | Hoffman | 354/337 X |
| 3,623,416 | 11/1971 | Anderberg | 354/313 X |

FOREIGN PATENTS OR APPLICATIONS

| | | | |
|---|---|---|---|
| 936,066 | 2/1948 | France | 354/312 |

*Primary Examiner*—Fred L. Braun
*Attorney, Agent, or Firm*—Morse, Altman, Oates & Bello

[57] ABSTRACT

A film and print processing apparatus comprises a cylindrical tank and a plurality of cylindrical reels having progressively smaller diameters for coaxial mounting within the tank. A film track is disposed helically, longitudinally or circumferentially about each reel and is operative as a guide for winding a film about the reels and as a spacer for holding the film away from the surface of the reels. Exposed photographic sheets are positioned within the reels for print processing.

10 Claims, 7 Drawing Figures

PHOTOGRAPHIC PROCESSING APPARATUS

BACKGROUND OF THE INVENTION

1. Field of Invention

The present invention relates to photographic apparatuses and, more particularly, is directed towards film processing apparatuses.

2. Description of the Prior Art

Photographic systems of various configurations have been manufactured for processing films. Generally, the film to be processed is wound spirally about a reel and the reel is immersed in a tank containing a photochemical solution. Due to the difficulty in winding the film on the reel, often times the film is wound improperly, which results in undeveloped spots at regions of the film where the emulsion is in contact with an adjacent turn. A further limitation of such systems is that a fixed quantity of processing solution is required for each film size. This limitation necessitates storage space and bookkeeping records for partially used solutions. Another disadvantage of such systems is that, in most cases, it is recommended that the tank be completely filled with reels. Such a requirement makes it necessary to have a variety of tank sizes on hand in order to accomodate various film sizes for efficient use of the photochemical solutions. Accordingly, such photographic systems have been introduced to the public with varying degrees of success.

SUMMARY OF THE INVENTION

It is an object of the present invention to provide a film and print processing apparatus which does not suffer from the heretofore mentioned disadvantages and limitations. The film and print processing apparatus is characterized by a cylindrical tank and a plurality of cylindrical reels having progressively smaller diameters, the reels coaxially mountable within the tank. In order to facilitate loading of a film on a reel, the periphery of each reel is provided with a helically disposed film track that is operative as a guide for winding the film on the reel and as a spacer for holding the film away from the reel periphery.

It is another object of the invention to provide a film processing apparatus in which the quantity of solution required for each reel is variable over a wide range and in which the number of films and/or prints to be processed simultaneously in one tank is variable over a wide range.

Other objects of the present invention will in part be obvious and will in part appear hereinafter.

The invention accordingly comprises the apparatuses and processes, together with their parts, steps, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
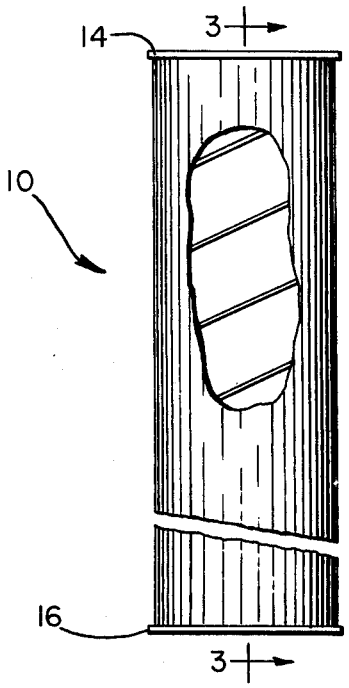
FIG. 1 is a perspective of a photographic processing apparatus embodying the invention.
Figure 3:
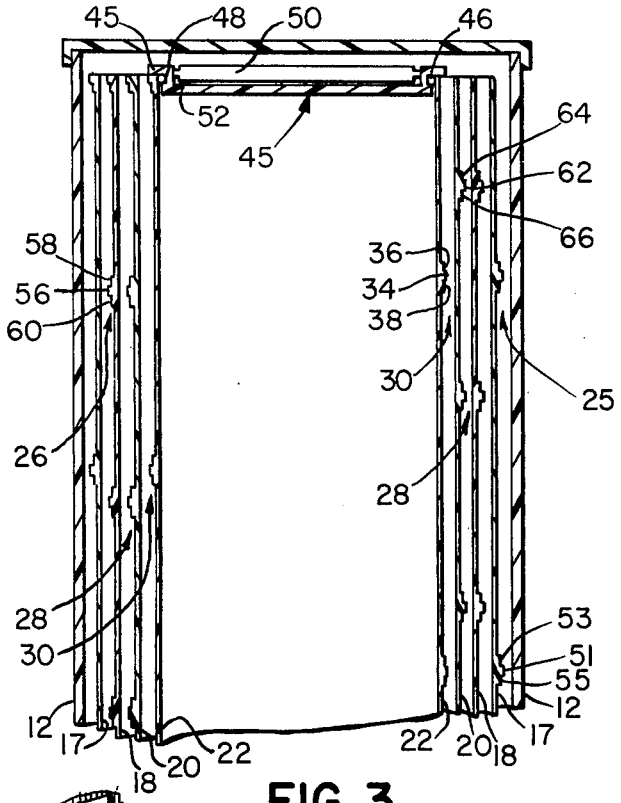
FIG. 3 is a sectional taken along the lines 3—3 of FIG. 1.
Figure 2:
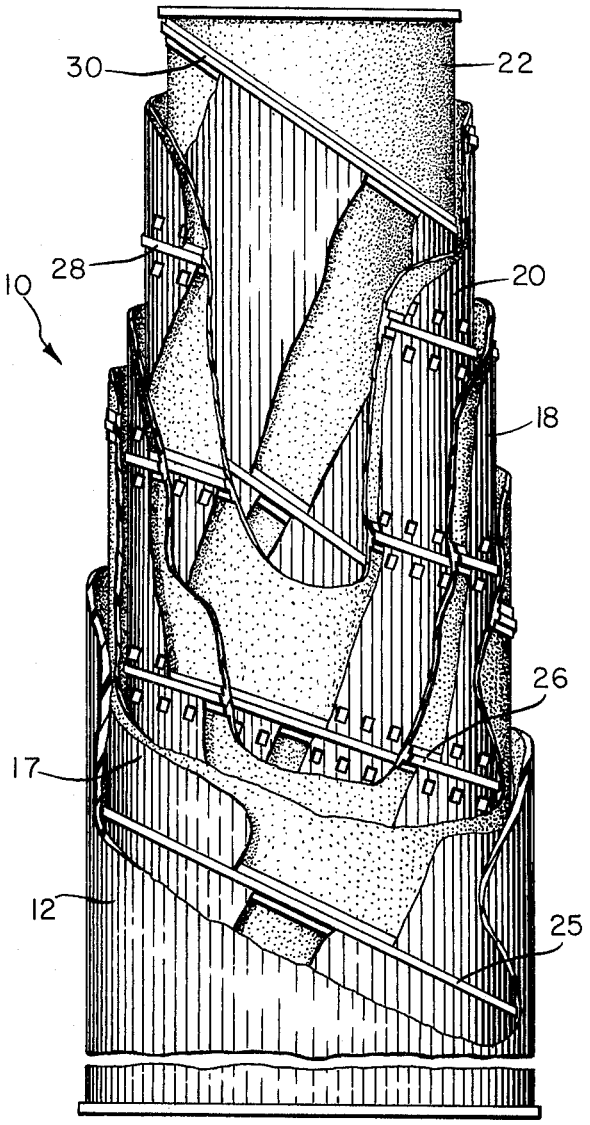
FIG. 2 is a front view, partially cutaway, of the film processing apparatus of FIG. 1 having a plurality of films wound thereon.

Referring now to the drawings, particularly FIGS. 1, 2 and 3, there is shown a film and print processing apparatus 10 comprising a cylindrical tank 12 having a pair of end caps 14, 16 and a plurality of cylindrical reels 17, 18, 20, 22 having progressively smaller diameters. The diameter of reel 17 is slightly smaller than the diameter of tank 12, reel 17 being received coaxially within tank 12. The diameter of reel 18 is slightly smaller than the diameter of reel 17, reel 18 being received coaxially within reel 17. The diameter of reel 20 is slightly smaller than the diameter of reel 18, reel 20 being received coaxially within reel 18. The diameter of reel 22 is slightly smaller than the diameter of reel 20, reel 22 being received coaxially within reel 20. In the illustrative embodiment, by way of example, the respective outside diameters of tank 12 and reels 17, 18, 20 and 22 are approximately 3 inches, 2¾ inches, 2½ inches, 2¼ inches and 2 inches. A radial clearance of approximately 1/16 of an inch is provided between adjacent surfaces, the wall thickness of the tank and the reels is 1/16 of an inch each. The length of tank 12 is approximately 14⅛ inches and the length of each reel 17, 18, 20, 22 and 24 is approximately 14 inches. Preferably tank 22 and reels 17, 18, 20 and 22 are composed of a polymer such as methyl methacrylate or a metal such as stainless steel.

As best shown in FIG. 3, reels 17, 18, 20 and 22 are provided with film tracks 25, 26, 28 and 30, respectively. Each film track defines a guide for winding films about the reels and for holding the films from the surface of the reels. Film track 30, shown in FIG. 3, is disposed helically about the outer periphery of reel 22. In a similar manner, film tracks 26 and 28 are disposed helically about the outer periphery of reels 18 and 20, respectively. The pitch of tracks 26, 28 and 30 is in the range of ¼ of an inch per revolution to 7 inches per revolution. In the illustrated embodiment, the pitch of tracks 25 and 30 is 2½ inches per revolution for size 120 film and the pitch of tracks 26 and 28 is 1 7/16 inches per revolution for size 135 film.

Figure 4:
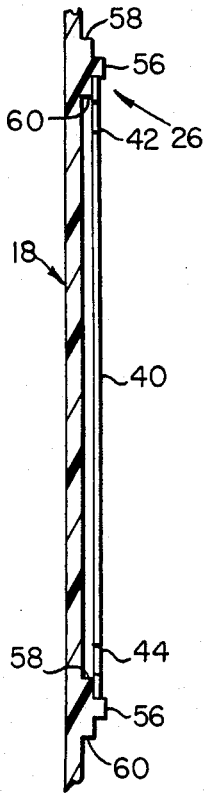
FIG. 4 is a sectional showing film on a film track.

Film track 26 includes a head 56 that is bounded by a pair of shoulders 58, 60. In right cross section, track 26 has a substantially T-shaped profile. The distance between head 56 on adjacent turns of track 26 is such that a film 40 is snugly received therebetween. As best shown in FIG. 4, exposed regions of film 40 rest between shoulders 58 and 60 of adjacent turns of track 26. That is, the margins of film 40 between perforations 42, 44 and the side edges of the film are supported by shoulders 58 and 60. Head 56 extends outwardly from the exterior periphery of reel 18 approximately five hundredths of an inch and each shoulder 56, 58 extends outwardly from the exterior periphery of reel 18 approximately two hundredths of an inch. In one embodiment, track 26 is composed of plastic and is integral with reel 18, for example, the reel and track are made by an extrusion process. In another embodiment, track 26 is in the form of a ribbon that is cemented to its associated reel 18 by means of a suitable adhesive.

Reels 17, 20 and 22 are provided with tracks 25, 28 and 30, respectively, which are similar in construction to track 26. Track 25 includes a head 51 that is bounded by a pair of shoulders 53 and 55. Track 28 includes a head 62 that is bounded by a pair of shoulders 64 and 66. Track 30 includes a head 34 that is bounded by a pair of shoulders 36 and 38.

Figure 5:
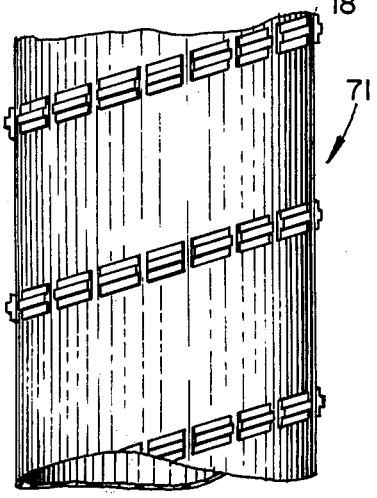
FIG. 5 is a front plan view of a reel having an interrupted film track.

Referring again to FIG. 3, it will be seen that a flanged cap 45 is provided for closing or sealing the top end of reel 22. A seal 46, for example an O-ring, is fitted into a seat 48 and engages the inner surface of reel 22. Cap 45 is provided with a collapsible handle 50 that retracts into a cutaway region 52 of the cap. Although not shown, it is to be understood that the bottom portion of reel 22 is provided with a similar configuration as the top portion of reel 22 for closing or sealing the bottom end with a cap. Although not shown, it is to be understood that caps are provided for closing and sealing each of the reels. In the illustrated embodiment in FIGS. 1–4, the tracks are continuous. In an alternate embodiment, the tracks are intermittent or broken as illustrated in FIG. 5 at 71 for facilitating longitudinal flow of processing solution. Also, in a further embodiment, the outer wall of each reel is fluted or embossed to allow access of the solution to the back of the films.

In operation, a film is wound about one of the tracks, for example track 26. A film clip (not shown) may be used to hold the film to the end of the track. Head 56 is operative as a guide that facilitates winding of film on reel 18 and shoulders 58, 60 are operative as a spacer for holding the film away from the reel surface. If reel 18 is the only reel to be loaded, then the caps are placed over the open ends and the reel is inserted into tank 12. Various photochemical solutions are poured into tank 12, using conventional processing techniques for development of the film or prints. The caps are operative to seal reel 18 and to minimize the quantity of photochemical solution required. If more than one reel is to be loaded, the film or films are wound on their respective reels as hereinbefore described. In the case where the four reels are loaded with film, cap 45 is pressed onto the ends of reel 22. Thereafter the developing process proceeds in the manner previously described. It will be readily appreciated from the foregoing description that the quantity of solution required can be varied over wide limits by appropriate sealing of the respective reels.

Figure 6:
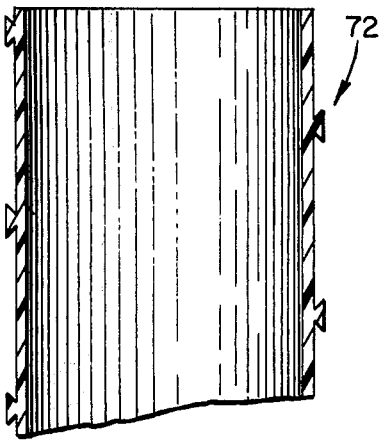
FIG. 6 is a sectional of an alternate embodiment of a reel showing a dove-tail film track.
Figure 7:
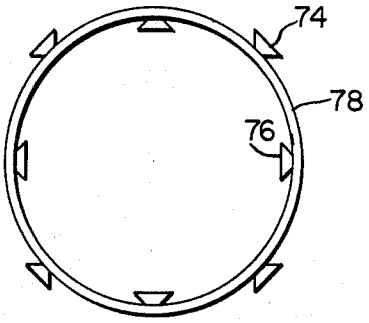
FIG. 7 is a top plan view of a further alternate embodiment of a reel.

In an alternate embodiment, tracks 25, 26, 28 and 30 have other than a T-shaped profile, for example a dovetail profile as shown in FIG. 6 at 72. In a further embodiment of the invention, each reel is provided with longitudinally extending tracks 74 and 76 on the exterior and interior surfaces, respectively, of a reel 78 as shown in FIG. 7. The longitudinally extending tracks are particularly adapted for processing sheet films.

In the case of making contact prints, the print film is first installed with the emulsion side out. Then, the negative is wound on the reels with the emulsion side in. After exposure, the negative is removed and the exposed print is in position for processing.

In the processing of enlargements, for example, an 8 × 10 inch sheet of exposed photographic paper fits neatly into a tube having a 2⅝ inch inside diameter. It has been found that longitudinal guides are not required in such an application, however, it may be desirable to provide small internal flanges at the tube margins in order to keep the print from falling out the end and to prevent abrasion of the print emulsion. In certain instances, an adhesive is used for temporarily bonding a print to the outer wall of the tube. One such type adhesive is a spray adhesive sold under the trade designation Blair Spray Stick. Another type is a double faced adhesive tape. It is to be noted that two prints can be processed in one tube, and, if the development is carried out under safe light in a transparent tank, the progress of the development can be watched.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A photographic processing apparatus comprising:

a. a tank having an internal cylindrical cavity for holding a solution;

b. at least first reel means and second reel means, each of said first and second reel means being a cylindrical member having open ends, said first reel means coaxially mountable within said internal cylindrical cavity, said second reel means coaxially mountable within said first reel means, said first reel means includes track means that defines a film guide and a film spacer, said second reel means including track means that defines a film guide and a film spacer;

c. a cap mounted to each open end of said second reel means for sealing said second reel means; and d. means for sealing said tank, said first reel means and said sealed second reel means totally contained and sealed within said sealed tank.

2. The photographic processing apparatus as claimed in claim 1 wherein said first reel means track means is disposed helically about the periphery of said first reel means and wherein said second reel means track means is disposed helically about the periphery of said second reel means.

3. The photographic processing apparatus as claimed in claim 2 wherein the outer walls of each of said first and second reel means is fluted and wherein each of said track means is an intermittent track.

4. The photographic processing apparatus as claimed in claim 2 wherein the pitch of said first reel means track means and of said second reel means track means is in the range of one quarter of an inch per revolution to seven inches per revolution.

5. The photographic processing apparatus as claimed in claim 1 wherein said first reel means track means includes a first track and a second track, said first track disposed longitudinally on the exterior periphery of said first reel means, said second track disposed longitudinally on the interior periphery of said first reel means.

6. A photographic processing apparatus comprising:

a. an open ended cylindrical tank;

b. means for sealing said cylindrical tank;

c. at least first reel means and second reel means, said first and second reel means being open ended cylindrical members of substantially equal length, said first reel means coaxially mountable within said cylindrical tank, said second reel means coaxially mountable within said first reel means;

d. a first track helically disposed about the periphery of said first reel means, said first track defining a guide for winding a film on said first reel means and a spacer for holding a film wound on said first reel means away from the periphery of said first reel means;

e. a second track helically disposed about the periphery of said second reel means, said second track defining a guide for winding a film on said second reel means and a spacer for holding a film wound on said second reel means away from the periphery of said second reel means; and f. a pair of caps mounted on the opened ends of said second reel means for sealing said second reel means, said first reel means and said sealed second reel with said caps contained totally and sealed within said sealed tank.

7. The photographic processing device as claimed in claim 6 wherein said first track includes a head and a pair of shoulders, said head bounded by said shoulders, said first track having a substantially T-shaped profile in right cross section.

8. The photographic processing device as claimed in claim 6 wherein the pitch of said first track and of said second track is in the range of ¼ of an inch per revolution to 7 inches per revolution.

9. The photographic processing device as claimed in claim 8 wherein the pitch of said first track is 2½ inches per revolution and wherein the pitch of said second track is 1 5/16 inches per revolution.

10. The photographic processing apparatus as claimed in claim 6 including third reel means coaxially mountable within said first reel means and about said second reel means, a third track mounted to the periphery of said third reel means, said third track means defining a guide for winding film on said third reel means and a spacer for holding a film wound on said third reel means away from the periphery of said third reel means.

* * * * *